US007097535B2

(12) United States Patent
Glashauser et al.

(10) Patent No.: US 7,097,535 B2
(45) Date of Patent: Aug. 29, 2006

(54) METHOD AND CONFIGURATION FOR CONDITIONING A POLISHING PAD SURFACE

(75) Inventors: Walter Glashauser, Poughkeepsie, NY (US); Benno Utess, Dresden (DE); Andreas Purath, Dresden (DE)

(73) Assignee: Infineon Technologies AG, Munich (DE)

( * ) Notice: Subject to any disclaimer, the term of this patent is extended or adjusted under 35 U.S.C. 154(b) by 428 days.

(21) Appl. No.: 10/114,773

(22) Filed: Apr. 2, 2002

(65) Prior Publication Data

US 2002/0142706 A1 Oct. 3, 2002

(30) Foreign Application Priority Data

Apr. 2, 2001 (EP) ..... 01108300

(51) Int. Cl.
*B24B 49/00* (2006.01)

(52) U.S. Cl. ..... 451/5; 451/56; 451/443

(58) Field of Classification Search ..... 451/5, 451/8, 41, 56, 443, 444
See application file for complete search history.

(56) References Cited

U.S. PATENT DOCUMENTS 5,743,784 A 4/1998 Birang et al.
5,823,854 A * 10/1998 Chen ..... 451/9
6,093,080 A 7/2000 Inaba et al.
6,149,512 A 11/2000 Wilson et al.
6,193,587 B1 2/2001 Lin et al.
6,288,648 B1 * 9/2001 Easter et al. ..... 340/635
6,609,962 B1 8/2003 Wakabayashi et al.
2002/0106971 A1 * 8/2002 Rodriquez et al. ..... 451/5

FOREIGN PATENT DOCUMENTS

JP 62 048 462 3/1987
JP 2000 263 418 A 9/2000
JP 2001 030 169 A 2/2001
WO WO 01/15865 A1 3/2001

* cited by examiner

*Primary Examiner*—Dung Van Nguyen
(74) *Attorney, Agent, or Firm*—Laurence A. Greenberg; Werner H. Stemer; Ralph E. Locher

(57) ABSTRACT

A method and a configuration for conditioning a polishing pad surface are described. The method includes measuring a rotation table current or voltage as an input for a motor driving the rotation of the polishing pad versus a rotating conditioning head. The electrical power input is used as a measure of an actual abrasion effective in regenerating the polishing pad. Since the polishing pad commonly deteriorates by repeated usage, i.e. debris settles down onto its surface, the abrasion efficiency decreases. The method issues a warning signal, in response to the electrical power input exceeding a limit, to take actions for maintaining the uniformity of the conditioning process. The polishing pad rotation can be accelerated or the conditioning head pressure force or rotation can be increased in response to the warning signal. Therefore, the polishing pad can be conditioned.

7 Claims, 2 Drawing Sheets

METHOD AND CONFIGURATION FOR CONDITIONING A POLISHING PAD SURFACE

BACKGROUND OF THE INVENTION

Field of the Invention

The present invention relates to a method for conditioning a polishing pad surface to be used for chemical mechanical polishing of semiconductor wafers. The polishing pad is mounted on a rotation table and the method uses a conditioning head having a conditioning pad. The invention also relates to a configuration for performing the method.

In manufacturing semiconductor wafers, planarization techniques have become important so as to comply with the ongoing increase of requirements for building layer structures, which e.g. cannot be formed by other etching techniques. Of the structures built up by planarization, shallow trenches, metal plugs containing tungsten, and inter-layer dielectrica are prominent examples. A well known method for planarization is chemical mechanical polishing of the wafer surfaces, where a slurry containing particles of, e.g., of aluminum oxide or silicon dioxide in de-ionized water with an chemical alloy of e.g. ferri-nitride ($Fe(NO_3)_3$), potassium hydroxide (KOH) or ammonium hydroxide ($NH_3OH$) respectively is used to chemically oxidate and mechanically abrade surface material. In particular, by usage of the chemical alloys a high selectivity for the polishing rates of, e.g., polysilizium or tungsten against silicon dioxide can be maintained.

An apparatus for chemical mechanical polishing (CMP) typically contains a rotation table, on which a polishing pad made of polyurethane is mounted. A rotatable polishing head holds the wafer, which is to be polished, and engages the wafer against the rotating wetted polishing pad. During polishing the polishing head, which either co-rotates or counter rotates with the polishing pad, can vary its position relative to the axis of the rotation table due to an oscillating arm. Thereby, the textured polishing pad surface receives the slurry, which serves for abrading the wafer surface. The abrasion rate depends on the respective rotation velocities, the slurry concentration and the pressure, with which the polishing head is engaged against the polishing pad.

Eventually, removed wafer surface material, chemically altered slurry material as well as deteriorated pad surface material settles down onto the profiled pad surface thereby decreasing the pad polishing efficiency. In order to counteract this so-called "pad glazing effect" a conditioning step is performed on the polishing pad surface, which provides a uniform, textured and profiled pad surface. In this step the debris is removed from the pad surface and the pores are re-opened to receive the slurry. Several methods for conditioning have been proposed among which use is made of: knifes or blades, silicon carbide particles, diamond emery paper or a ceramic structure.

The process of conditioning can be carried out either during or after the polishing step. In one example diamond emery paper is mounted on a conditioning head, which is—analogously to the polishing head—carried by an additional oscillating arm. Diamond particles are encapsulated in a nickel grit mounted on a socket layer. The diamond particles protrude from the nickel surface to various extents—ranging from being fully encapsulated to just being slightly stuck to the nickel layer.

The so structured conditioning pad grinds over the resilient polyurethane polishing pad surface in a rotation movement of the conditioning head, which is being engaged onto the polishing pad. After the conditioning step the efficiency of abrasion is substantially restored resulting in a prolonged lifetime of the pad and less operator efforts to replace deteriorated pads. Nevertheless, even the improved lifetime of the polishing pad due to conditioning is limited to 12–18 hours, after which the polishing pad being mounted to the rotation table by an adhesive is to be replaced by a new one.

In the art of conditioning the problem arises of decreasing abrasion rates during the lifetime of the polishing pads. The polishing pad deteriorates continuously, because the surface of the pad becomes unsteady and the compressibility of the pad changes due to thinning.

Both effects result in a decrease in uniformity. On the other hand, the conditioning head abrasive material, e.g. the diamonds encapsulated in the nickel layer either get lost with time or are rounded due to mechanical interaction with the pad surface material. This also leads to a reduction of the abrasion rate as a function of time. These features disadvantageously result in a non-uniformity of the polishing process.

In International Patent Disclosure WO 01/15865 a CMP-apparatus with a rotation table, a polishing pad and a conditioning head are disclosed, the latter being controlled by a control unit, which is connected to an electrical current sensor for measuring electrical power input to the conditioning head. A target frictional force is set, which is to be held constant, and the control unit signals a rotation actuator of the conditioning head to adjust conditioning speed in response to the signals received from the electrical current sensor.

U.S. Pat. No. 6,093,080 discloses a method, where the electrical power input to the rotation table is measured for calculating an ideal set of parameters for a following conditioning process. The electrical power input is measured during a wafer polishing process. The mechanical abrasion resistance of the wafer against the pad is considered to represent a status of deterioration of said pad.

SUMMARY OF THE INVENTION

It is accordingly an object of the invention to provide a method and a configuration for conditioning a polishing pad surface which overcome the above-mentioned disadvantages of the prior art devices and methods of this general type, in which a uniformity of the process of chemical mechanical polishing is established, thereby increasing the wafer manufacturing quality and reducing the process time.

With the foregoing and other objects in view there is provided, in accordance with the invention, a method for conditioning a polishing pad surface of a polishing pad used for chemical mechanical polishing of semiconductor wafers. The method includes setting a limit to an electrical power input of a motor rotating a rotation table supporting the polishing pad, applying a conditioning head having a conditioning pad to the polishing pad surface with a pressure force, rotating the rotation table with the polishing pad surface using the motor having the electrical power input for abrading the polishing pad against the conditioning pad, and measuring the electrical power input to the motor resulting in a measured electrical power input. The measured electrical power input is compared with the limit of the electrical power input. A warning signal is then issued if the measured electrical power input exceeds the limit.

According to the method of the present invention the electrical current or voltage as an electrical power input to the motor, which drives the rotation of the rotation table, is measured in order to retrieve a measure for the abrasion rate. The limit, which is set to the electrical power input, i.e. the current or the voltage, therefore immediately corresponds to the abrasion power needed to remove the debris from the pad surface and to reopen the pores. Due to the deterioration of the polishing pad and the growing obtuseness of the conditioning head the abrasion typically degrades with time, and therefore the electrical power input decreases, if a constant rotation rate is to be maintained.

Since a rotation table generally requires fine adjustable motor drives and electrical power input sensors in order to monitor the polishing process of wafers, the device and the method according to the present invention can be advantageously combined and realized with those existing requirements thereby saving costs and leaving a CMP-tool simple as possible. However, measuring another electrical power input, e.g., that of a conditioning head rotating on a polishing table has a disadvantage that extra sensors and control units would have to be incorporated within a CMP-apparatus.

Typically, the rotating conditioning head oscillates across the polishing pad surface from the center to the edge and back to its origin. During this movement the electrical current or voltage supplied to the motor receives a maximum value at a position of the conditioning head near the edge of the polishing pad. In case of missing deterioration of the polishing pad the electrical current or voltage as a function of time would be reproduced from oscillation cycle to oscillation cycle.

In the presence of deterioration the function curve decreases for an oscillation cycle with respect to the previous cycle. According to the present invention a limit corresponding to either just one threshold value or a function limit corresponding to a oscillation cycle is set, which in case of deterioration can be passed over by a measured value, or a measured table current function curve, of the electrical power input, respectively. After each measurement a comparison is made between the measured electrical power input and the Bet limit. Once the pass over has occurred a warning signal is issued, that may be evaluated and interpreted automatically or by an operator.

A second limit can also be set marking a tolerance interval for electrical power inputs taken in connection with the first limit. For example there might be the case, that the abrasion rate increases for some reason therefore the pad lifetime decreases. When not noticed this can lead to scratched or damaged. In this case the electrical power input would increase and eventually pass over the one or two limits, depending on whether just one maximum limit or a tolerance range is applied.

Due to the method of the present invention the non-uniformity of the conditioning process can advantageously be detected, and a sufficient quality of the polishing pad for the CMP-process of wafers can be provided. In particular insufficiently regenerated polishing pads can be prevented from being used for further polishing wafers. Rather, actions can be undertaken by control mechanisms to re-establish uniform process conditions.

In one aspect the adjustment of the electrical power input is considered, which provides a rotation table angular velocity to be within a tolerance range. In this case a closed-loop control circuit is built to hold the rotation rate of the polishing pad nearly constant. The motor receives such an amount of electrical power, i.e. current or voltage, such as to provide a constant angular velocity.

In a further aspect the action taken to provide a sufficient conditioning quality is to replace the conditioning pad or the polishing pad in response to the signal issued. The conditioning process is terminated for the substitution. Advantageously, situations with considerably deteriorated polishing pads or conditioning pads then cannot occur.

In a further aspect the tolerance range of rotation table angular velocities maintained by the (inner) closed loop control circuit is itself adjusted in an (outer) closed loop control circuit, which is enabled by evaluating the warning signal. For example a warning signal is issued due to a decreased electrical power input, which is due to a reduced abrasion rate, and the lower limit is passed over by measured values for electrical power input. Then, the angular velocity that is to be achieved with a constant value is once adjusted to a higher value for providing an abrasion rate that is uniform with time. The electrical power input to the motor then increases again in a self-adjustment step in order to maintain the original rotation rate.

An important issue is, that the electrical power input takes values, which are the result of the rotation rate of the polishing pad rotation table in combination with a time dependent abrasion resistance. Since in this aspect the abrasion rate of a slightly deteriorated polishing pad is held nearly constant by simply increasing the rotation velocities, a longer utilization time of a polishing pad or conditioning pad is advantageously provided. Thus, the water quality is increased and the costs for the CMP-process are reduced due to the smaller amount of polishing pads needed per time.

In a further aspect the abrasion rate is held constant by increasing the pressure force of the conditioning head in response to the issued signal. This aspect may also by realized by a closed loop control circuit.

In a further aspect the rotation rate of the conditioning head is adjusted in response to the issued warning signal, such that the electrical power input remains nearly constant or at least within the limit for providing a uniform abrasion rates.

According to the present invention a configuration for performing the method explained above is provided, which contains a conditioning head with a conditioning pad, a polishing pad having a surface being mounted on a rotation table, a motor for rotating the rotation table, an electrical current measurement device for measuring the electrical power input to the motor, and a control unit, which is connected to the measurement device and to the motor. In a preferable embodiment the control unit acts as a part of the closed loop control circuit to provide a uniform abrasion rate for the polishing pad.

Other features which are considered as characteristic for the invention are set forth in the appended claims.

Although the invention is illustrated and described herein as embodied in a method and a configuration for conditioning a polishing pad surface, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
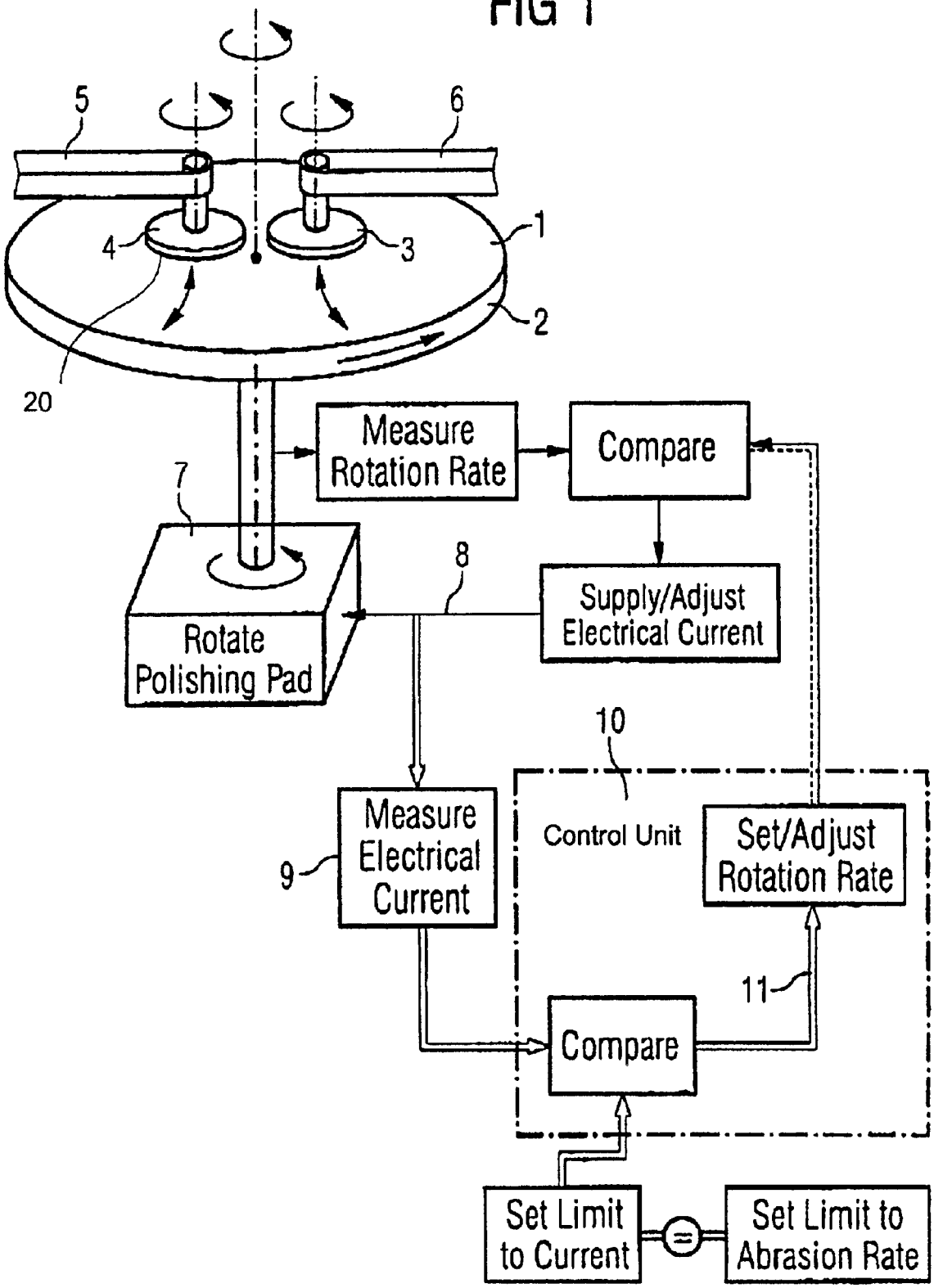
FIG. 1 is a diagrammatic, illustration schematically showing a CMP-aperture with a conditioning head and a polishing head, and a flowchart of an embodiment according to the method of the invention.

Referring now to the figures of the drawing in detail and first, particularly, to FIG. 1 thereof, there is shown a configuration and a method according to the present invention. A rotation table 2 is mounted with a polishing pad 1 and is rotated by a motor 7. For polishing a wafer, which is held beneath a polishing head 3, the wafer is pressed and engaged by the polishing head 3 against the polishing pad 1. While the wafer is rotated in the same direction as the rotation table 2 but both having different axes, a polishing head oscillating arm 6 oscillates the polishing head 3 across the polishing pad 1 in order to achieve a uniform removal of wafer surface material over the wafer surface. During or after the polishing step, conditioning is performed via a conditioning head 4 mounted with a conditioning pad 20. The conditioning head 4 rotates as well, e.g., in the same direction as the rotation table 2, and is also oscillated across the polishing pad 1 by a conditioning head oscillating arm 5 from about the center to the edge of the polishing pad 1, as indicated by the arrows in FIG. 1 in the vicinity of the conditioning head 4.

Attached to the configuration shown is a flowchart of two coupled closed loop control circuits. The rotation of the rotation table 2 initiated by the motor 7 is measured and then compared with a rotation rate value, i.e. a limit or tolerance range or rates, that is conventionally set in advance of the process. If the measured rate exceeds the limit or range the electrical power input, i.e. the electrical current in this embodiment, is adjusted such as to return the rotation rate initiated by the motor 7 back into the rotation rate range set priority.

According to the present invention an electrical current input 8 to the motor 7 is related to an abrasion rate that is desired to be uniform during the whole process.

Accordingly, tolerance range limits of the abrasion rate are transformed to tolerance range limits of the electrical current input 8 and are preferably set fixed during the lifetime of the polishing pad 1. A measurement device 9 for the electrical current input 8 delivers its measured values for the oscillation cycles to a control unit 10 that performs a comparison step of the measured electrical current curve with the electrical current limits.

Figure 2:
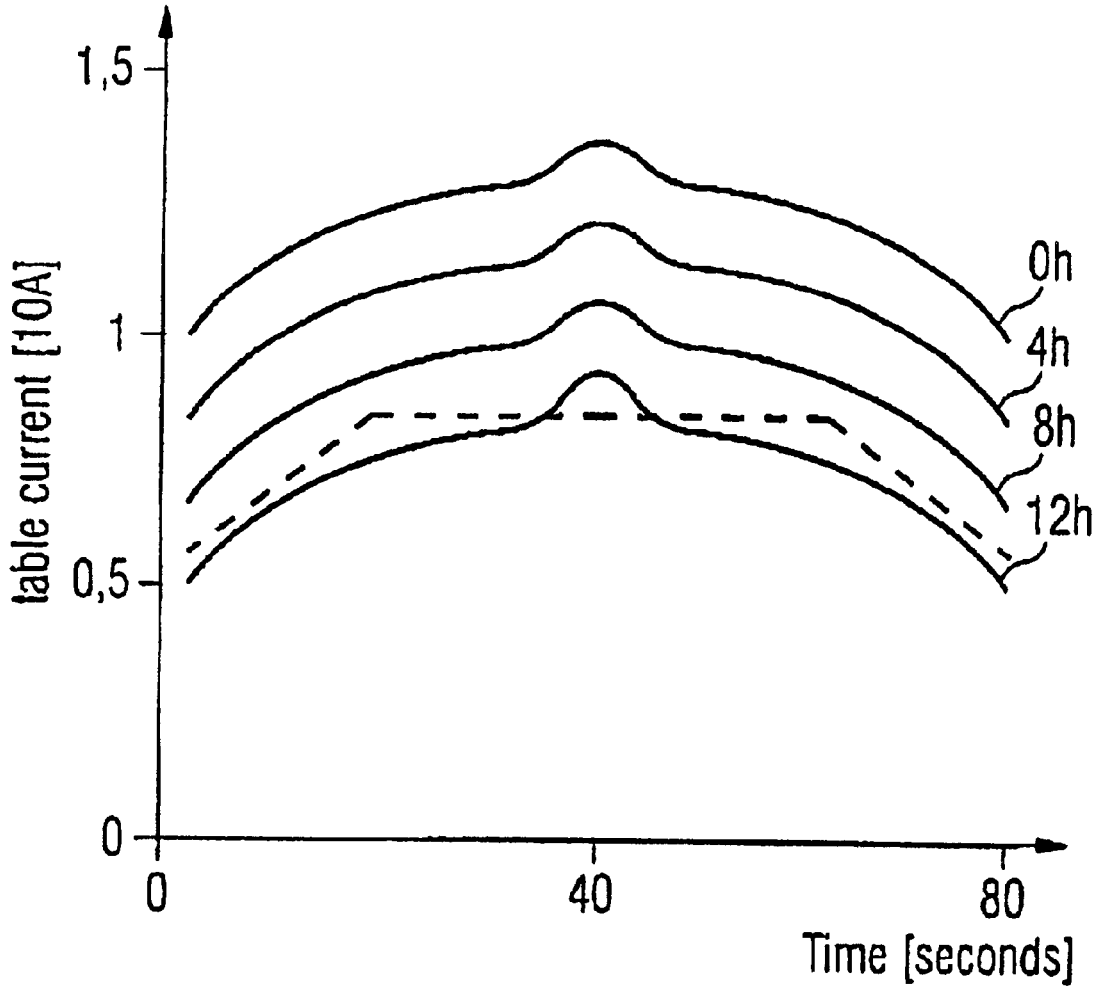
FIG. 2 is a graph showing a measured electrical power input for conditioning head oscillation cycles as a function of oscillation time for four conditioning cycles (solid lines) and a function limit (dashed line), taken during the lifetime of a polishing pad.

A typical evolution of measured electrical current curves for selected oscillation cycles of the conditioning head 4 over the polishing pad 1 is shown in FIG. 2. The top-most curve represents an oscillation cycle near the first use of a new, conditioning pad 20. With ongoing time the corresponding curves represented by solid lines in FIG. 2 decrease to smaller values of the electrical table current due to a decreasing sharpness of the conditioning head 4 or to a decrease of the down force of the conditioning head 4. The abrasion rate therefore decreases as well, while the rotation velocity remains nearly constant due to the aforesaid inner closed loop control circuit known in the art. Eventually, after a few hours the table current curve passes over the limit to the electrical table current 8, which is set to present the lower limit of the tolerable abrasion rate. The corresponding table current limiting curve is represented by the dashed line.

The inner closed loop control circuit can be implemented implicitly by the corresponding electrical motor 7, which just takes the power input it needs to provide a certain mechanical power output, or it is constructed explicitly with corresponding units controlling the mechanical power input and output of the motor 7.

Since after each oscillation cycle the measured electrical table current curve is compared with the limit table current curve, the event of passing over of the former over the latter—at least in parts—is detected in the comparison step.

A warning signal is issued indicating that the lower limit of the abrasion rate is passed over. The outer closed loop control circuit according to the present invention indicated by the thick arrows in FIG. 1 is constructed by taking the warning signal 11 as the event to adjust, i.e. increase, the rotation rate, that the motor 7 has to accomplish in its inner closed loop control circuit. According to the present invention the adjusted rotation rate as an input to the comparison step of the inner closed loop control circuit is now only set in advance for one oscillation cycle instead of the life-time of the conditioning pad, or head respectively. Therefore, the abrasion rate is advantageously held nearly uniform, thereby providing a homogeneous, nearly time-independent quality resulting in uniform process conditions for manufacturing semiconductor wafers during CMP.

There is no clear relation between the electrical table current 8 and deterioration of the polishing pad 1, but a change in the conditioning process due to variations in the conditioning head 4/disc sharpness and/or down force can be observed. Using the present method, the conditioning process of the polishing pad 1 can be advantageously controlled, and in the case of a decrease in polishing efficiency, the conditioning process as a cause for the problem can be ruled out, if e.g. the electrical current reveals no extraordinary behavior, i.e. does not exceed specified limits.

We claim:

1. A method for conditioning a polishing pad surface of a polishing pad used for chemical mechanical polishing of semiconductor wafers, which comprises the steps of:

setting a limit to an electrical power input of a motor rotating a rotation table supporting the polishing pad;

applying a rotating conditioning head having a conditioning pad to the polishing pad surface with a pressure force, the rotating conditioning head oscillating in a cycle across the polishing pad surface from a center position of the polishing pad to an edge of the polishing pad and back to the center position;

rotating the rotation table with the polishing pad surface using the motor having the electrical power input for abrading the polishing pad against the conditioning pad;

measuring the electrical power input to the motor for each oscillation cycle resulting in a measured electrical power input;

comparing the measured electrical power input with the limit of the electrical power input; and issuing a warning signal if, upon comparing a motor current to the limit, the measured electrical power input exceeds the limit.

2. The method according to claim 1, which comprises adjusting the electric power input for setting a rotation table angular velocity to be within a tolerance range.

3. The method according to claim 1, which comprises:

terminating the conditioning of the polishing pad; and replacing one of the conditioning pad the polishing pad in response to the warning signal.

4. The method according to claim 2, which comprises adjusting the tolerance range of the rotation table angular velocity in response to the warning signal, such that the electrical power input is adjusted and remains within the limit for providing a uniform abrasion rate.

5. The method according to claim 1, which comprises adjusting the pressure force of the conditioning head in response to the warning signal, such that the electrical power input remains within the limit for providing a uniform abrasion rate.

6. The method according to claim 1, which comprises adjusting a rotation rate of the conditioning head in response to the warning signal, such that the electrical power input remains within the limit for providing a uniform abrasion rate.

7. A configuration for chemical-mechanical polishing of wafers, comprising:

a rotation table;

a conditioning head having a conditioning pad disposed on one side of said rotation table, said conditioning head oscillating in a cycle across a surface of said rotation table from a center position to an edge of said rotation table and back to said center position;

a polishing pad having a surface and mounted on said rotation table;

a motor coupled to and rotating said rotation table, said motor receiving an electrical energy supply;

a current measurement device measuring the electrical energy supply received by said motor for each oscillation cycle of said conditioning head; and a control unit connected to said current measurement device and to said motor.

* * * * *